United States Patent [19]

Burnett

[11] Patent Number: 4,753,282

[45] Date of Patent: Jun. 28, 1988

[54] MOLDING REGISTER SYSTEM WITH IMPROVED CLOSER ASSEMBLY

[75] Inventor: Joel M. Burnett, Chagrim Falls, Ohio

[73] Assignee: Combustion Engineering, Inc., Windsor, Conn.

[21] Appl. No.: 80,351

[22] Filed: Jul. 31, 1987

[51] Int. Cl.[4] ..... B22D 33/04

[52] U.S. Cl. ..... 164/168; 164/159; 164/339

[58] Field of Search ..... 164/168, 159, 339

[56] References Cited

U.S. PATENT DOCUMENTS

| | | | |
|---|---|---|---|
| 2,754,555 | 7/1956 | Young | 164/339 |
| 3,017,675 | 1/1962 | Young | 164/339 |
| 3,039,157 | 6/1962 | Bobenmyer | 164/339 |
| 3,339,626 | 9/1967 | Bührer et al. | 164/339 |
| 4,261,413 | 4/1981 | Blower et al. | 164/168 X |
| 4,588,014 | 5/1986 | Blower et al. | 164/168 X |

*Primary Examiner*—Nicholas P. Godici
*Assistant Examiner*—J. Reed Batten, Jr.
*Attorney, Agent, or Firm*—William W. Habelt

[57] ABSTRACT

A register system is provided for making molds for metal casting which reduces flaws attributable to parting line shift. This is accomplished by urging the cope mold flask (11) against two fixed stops (50, 52) on the long axis, and one fixed stop (54) on the short axis of the flask. This same register principle is applied in the drag mold making station 18, where the drag flask (15) is urged against two fixed stops (86, 88) on the long axis, and one fixed stop (90) on the short axis of the flask. At the closer station (24), where the mold halves are assembled using the improved closer 150 which comprises in an assembly of cooperative association an upper support framework 160, an intermediate support framework 170 suspended from the upper support framework 160 as so to permit only pure vertical motion therebetween, a cope capture framework 180 freely suspended from the intermediate support framework 170, and a drag capture framework 190 which is suspended from the cope capture framework 180 so as to permit only pure axial translation therebetween. The flasks are properly aligned to the patterns at the mold making stations, and again properly aligned to each other at the closer station, so as to eliminate parting line shift problems of the mold halves.

6 Claims, 8 Drawing Sheets

MOLDING REGISTER SYSTEM WITH IMPROVED CLOSER ASSEMBLY

BACKGROUND OF THE INVENTION

In conventional molding practice, alignment of the flask to the pattern, and flask-to-flask, is achieved by means of pins and bushings. More specifically, in most instances pins are provided on the pattern which can engage bushings on the drag flask at the mold making station. These same bushings are then used to engage pins on the cope flask at the closing station, where the drag and cope flasks are assembled. The above achieves the alignment requirement for patterns to flask, and flask-to-flask.

One of the problems frequently encountered in conventional molding systems is a casting flaw attributable to parting line shift. One of the principal causes of this casting defect is the general problem associated with the clearances required between pins and bushings, and the increase in those clearances caused by wear on these critical alignment parts. Typically, clearances on the order of ten thousandths of an inch are required between pattern pins and their mating bushings on the drag in order to prevent binding action as the flask is lowered onto the pattern or later on when it is drawn. Similar clearances are required in making the cope, and the same clearances are also then encountered in the match between the cope and the drag.

In addition to these initial clearances, it is not uncommon to see wear on pins and/or bushings which can often accumulate to an additional ten thousandths of an inch. It can therefore be seen that with worn pins and bushings, a drag might be shifted relative to its pattern as much as fifteen thousandths of an inch from a theoretical true desired position. Similarly, a cope can be shifted by a corresponding amount, but in the opposite direction. When the cope and drag are eventually closed, an error of as much as forty-five thousandths of an inch can occur between the cope and drag parting surfaces from these variables alone. Such a shift in mating surfaces can result in minimum wall thickness in the resultant casting not being met. To compensate for such a mating shift, it is necessary in pin and bushing castings to enlarge overall the pattern so that wall-thickness specifications will be achieved. This means pouring more metal than necessary for each casting.

A recent development in the art of casting which eliminates many of the alignment problems experienced in pin and bushing casting is presented in commonly assigned U.S. Pat. No. 4,628,986, issued Dec. 16, 1986, to Donald L. Southam. As disclosed therein, a molding register system is provided which eliminates nearly all the error caused by pin and bushing clearances and wear. Registry is achieved by urging the rectangular flask to two fixed surfaces (or one long surface) on the long axis and one fixed surface on the shorter axis of the flask. This registry principle is applied in both the cope and drag mold making locations, and also the closer location, where the mold halves are assembled, and utilizes the same flask surfaces for all registration purposes.

In implementing this registry scheme, it is critically important to assure parallelism between the cope and drag parting surfaces during the closing operation. Failure to achieve parallelism can lead to errors in the closing operation resulting in objectionable core shaving.

SUMMARY OF THE INVENTION

An improved closer is provided comprising a plurality of separate frameworks which are linked together in an unique cooperative association which provides support of the cope and drag during closing of the mold, while permitting controlled relative movement in order to assure parallelism between the cope and drag parting surfaces during closure of the cope and drag to form the mold.

DESCRIPTION OF THE PREFERRED EMBODIMENT

Figure 1:
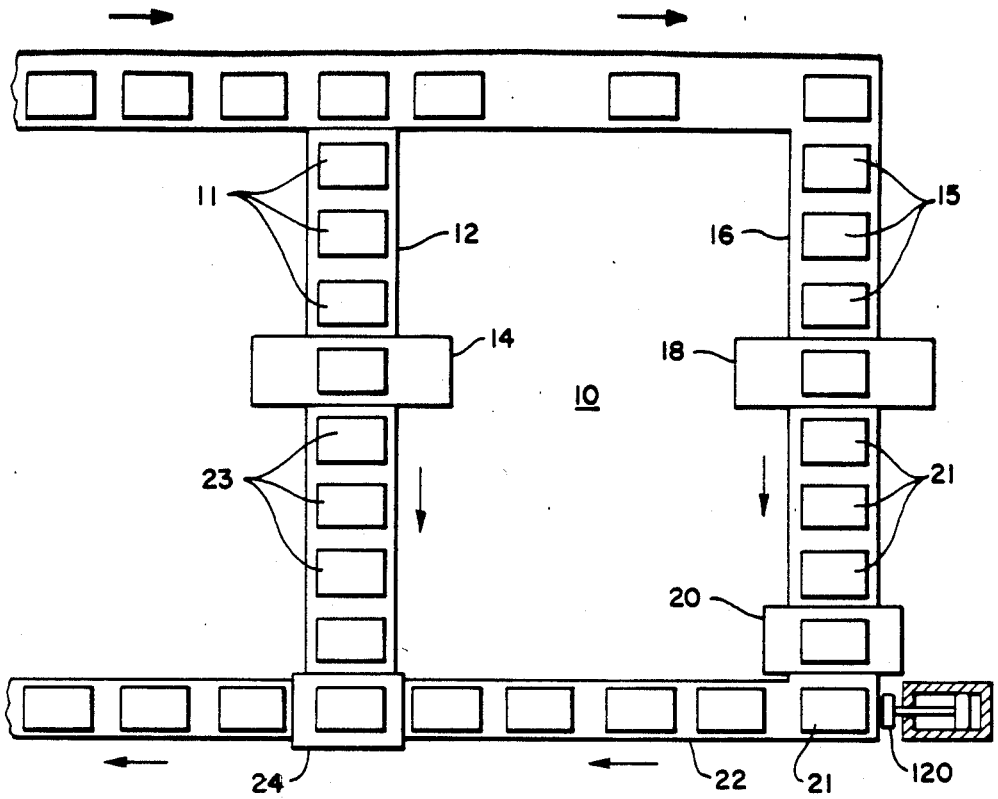
FIG. 1 is a schematic of a mold making assembly incorporating the register system of the invention.

Looking now to FIG. 1, numeral 10 designates a mold making assembly line in its entirety. Empty flasks 11 returned from the casting station enter the cope mold making conveyor line 12, where they are positioned over a pattern board, filled with sand, and the sand compacted, at the cope mold making station 14. Similarly, empty flasks 15 returned from the casting station enter the drag mold making line 16, where they are positioned over a pattern board, filled with sand, and the sand compacted, at the drag mold making station 18. The drag flasks then pass through a rollover station 20, where they are turned over, so that the pattern side is facing up.

The drag molds 21 after being rolled over, move along conveyor line 22 to the closer station 24. During this travel, cores are usually placed in the drag mold halves. At the closer station 24, the cope molds 23 are brought in above the drag mold halves, and positioned thereon, forming a complete mold, ready to be moved along the conveyor line to the pouring station, where a casting is poured. The movements of the various conveying lines 12, 16, and 22 are all coordinated, so that they move together. Thus for example every 30 seconds, which would be a typical indexing period, the flasks are moved ahead one step in the conveyor line. Since conveyor 22 carries the mold halves in a direction corresponding to their long axis, and conveyors 12 and 16 moves the mold halves in a direction corresponding to their short axis, conveyor 22 will move correspondingly further during each indexing period. In this case, provision is made typically at units 21 and 24 to synchronize with the continuously moving conveyors.

Figure 2:
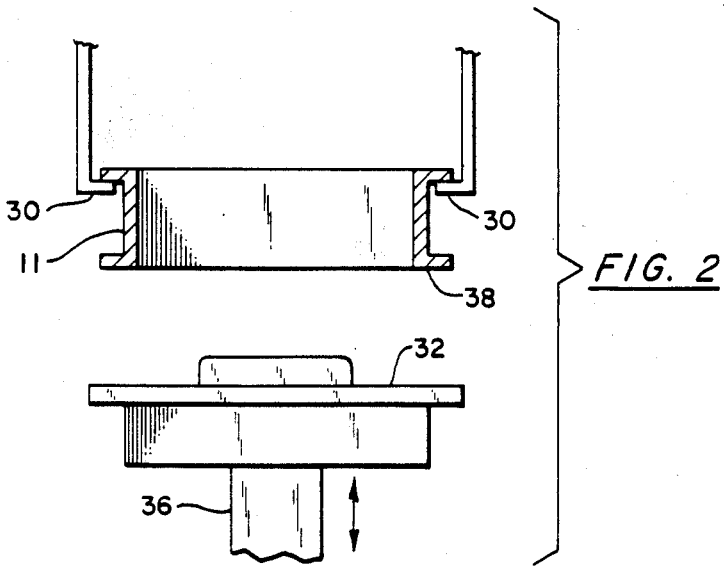
FIG. 2 is a view of the cope mold making station.

Looking now to FIGS. 2–5, more of the details of the cope mold making station 14 are shown. As can be seen in FIG. 2, a cope flask 11 is brought into the molding station 14 in any suitable manner, for example by fingers 30, which can be supported by movable overhead structure. The fingers 30 bring the flask 11 into a position above the pattern board 32, and stops. A piston-cylinder arrangement in a stachion 36 then raises the pattern board 32 into contact with the lower flange 38 of the flask. At this time, the flask is accurately positioned with respect to the pattern, as will be described in greater detail below.

Figure 3:
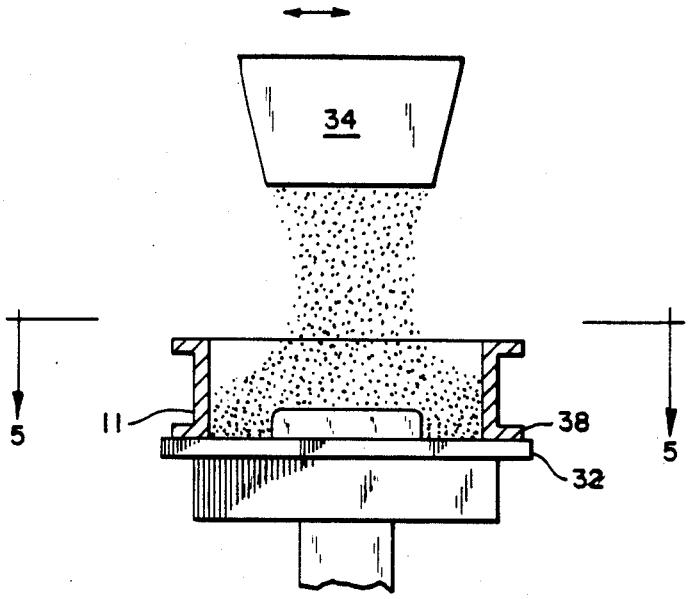
FIG. 3 is a view similar to FIG. 2, with the cope flask in the sand fill position.

Looking now to FIG. 3, after the flask 11 has been positioned on the pattern board 32, the fingers 30 are caused to overtravel and thereby disengage from the flask and the register system accurately positions the flask relative to the pattern. At this time, a sand supply 34 fills the flask with sand. The sand supply 34 is then shuttled back to a position out of the way, and a squeezing mechanism 42 (FIG. 4) is shuttled in above the flask. The sand supply 34 and the squeezing mechanism 42 can be mounted on the same overhead mechanism (not shown) so that they can be alternately shuttled back and forth from opposite sides by any suitable means.

Figure 4:
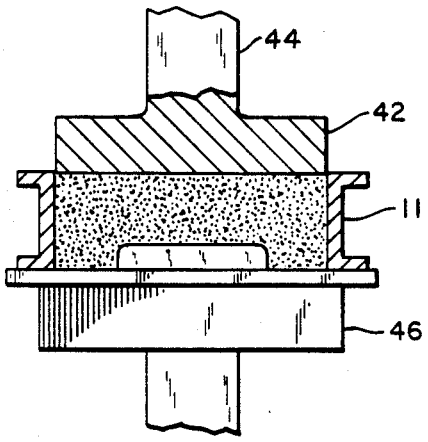
FIG. 4 is a view similar to FIG. 3, showing the cope flask in the sand compaction position.

Referring now to FIG. 4, the squeezing mechanism 42 is moved downwardly into contact with the upper sand surface by means of a piston-cylinder arrangement connected to shaft 44, thus exerting a large force to this surface. At the same time table 46 subjects the sand to a jolting or rapping action by any suitable means, such as an air or hydraulic motor, thus compacting the sand, which contains enough binder material, such as clay, to form a semi-hard mold within the flask. The finished mold half, still carried in its flask, is then moved out of the mold forming station 14 (FIG. 1) after the squeezing mechanism 42 has been raised out of the way. All of the above is accomplished during one indexing time period, such as 30 seconds.

Figure 5:
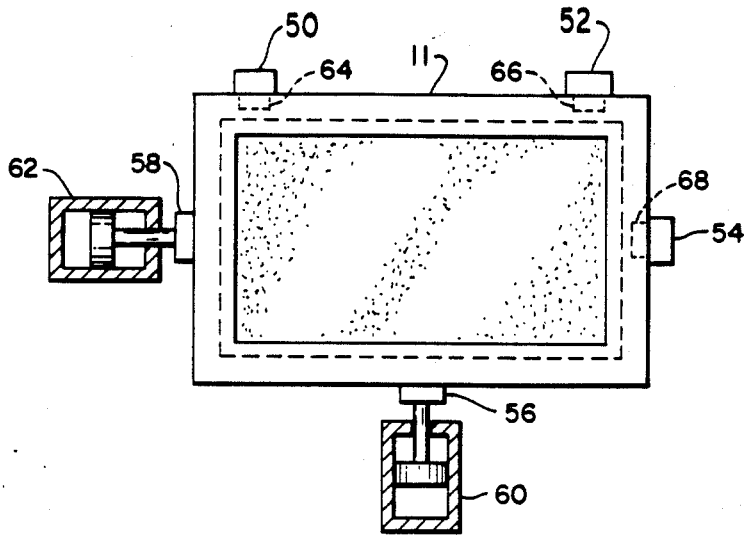
FIG. 5 is a plan view taken on lines 5—5 of FIG. 3, showing the register system of the invention.
Figure 6:
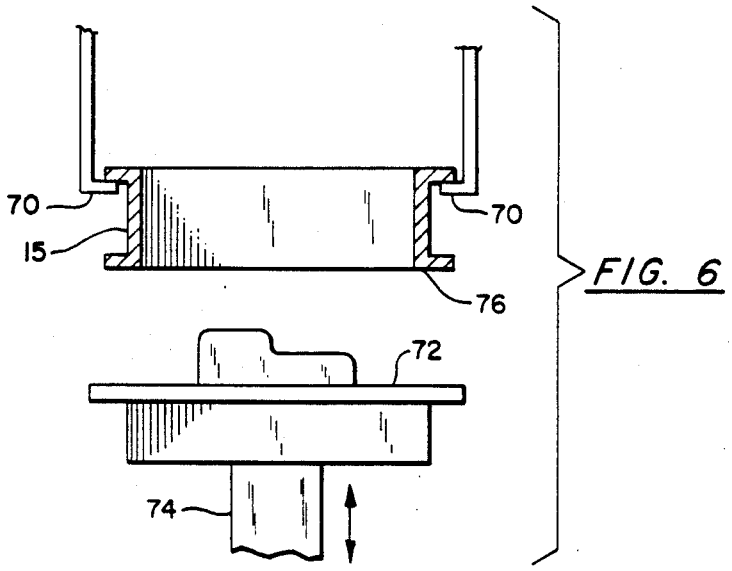
FIG. 6 is a view of the drag mold making station.
Figure 7:
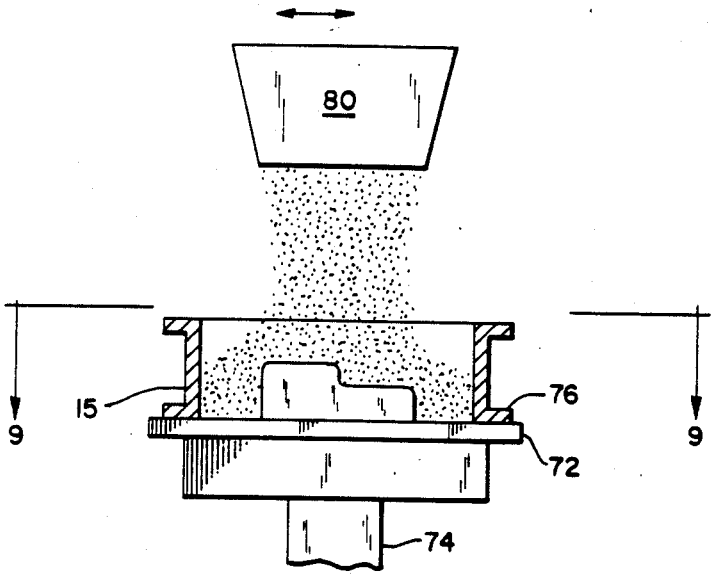
FIG. 7 is a view similar to FIG. 6, with the drag flask in the sand fill position.
Figure 8:
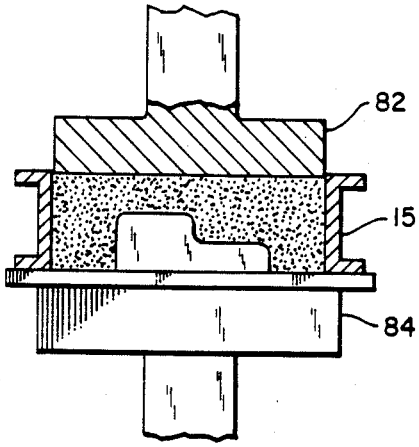
FIG. 8 is a view similar to FIG. 7, showing the drag flask in the sand compaction position.

Referring now to FIG. 5, the register system at the cope mold forming station 14 will be described. After the empty flask 11 has been set down on the pattern board 32, and the fingers 30 have released it, a pair of stop members 50, 52 lying along the longitudinal side of the flask, and a third stop member 54 lying along the transverse side of the flask, are employed to accurately locate the flask. The stop members are typically mounted on the pattern or pattern support holster. A pair of pusher members 56 and 58 are used to move the flask to the stop members. The piston-cylinder actuator 60 for pusher 56 is then actuated, so as to push the flask over until it contacts stops 50, 52. Actuator 62 is then actuated, so that pusher member 58 moves the flask 11 into contact with stop 54, at this time, the flask 11 has been accurately indexed, or positioned, with regard to the pattern, and the sand can thereafter be poured in, and the cope mold can be finished. Hardened steel wear plates 64, 66 and 68 can be attached onto the sides of the flask 11 to coact with stop members 50, 52 and 54, so that they do not quickly wear at these points.

Referring now to FIGS. 6–9, the drag mold making station is shown in more detail. Similarly to what is done in the cope mold making station, a drag flask 15 is brought into the molding station 18 in any suitable manner, for example by fingers 70, which can be supported by movable overhead structure. The fingers bring the flask 15 into a position above the pattern board 72, and stops. A piston-cylinder arrangement in stanchion 74 raises the pattern board 72 into contact with the lower flange 76 of the flask. At this time, the flask is accurately positioned with respect to the pattern as will be described in greater detail with regard to FIG. 9. Looking now to FIG. 7, after the flask 15 has been positioned on the pattern board 72, the register system then accurately positions the flask relative to the pattern. At this time, a sand supply 80 fills the flask with sand. The sand supply 80 is then shuttled back to a position out of the way, and a squeezing mechanism 82 is moved downwardly into contact with the upper sand surface, while jolting the flask 15 by means of table 84 to compact the sand. The finished mold half is then moved on, to the rollover station 20 (FIG. 1), after the squeezing mechanism has been raised.

Figure 9:
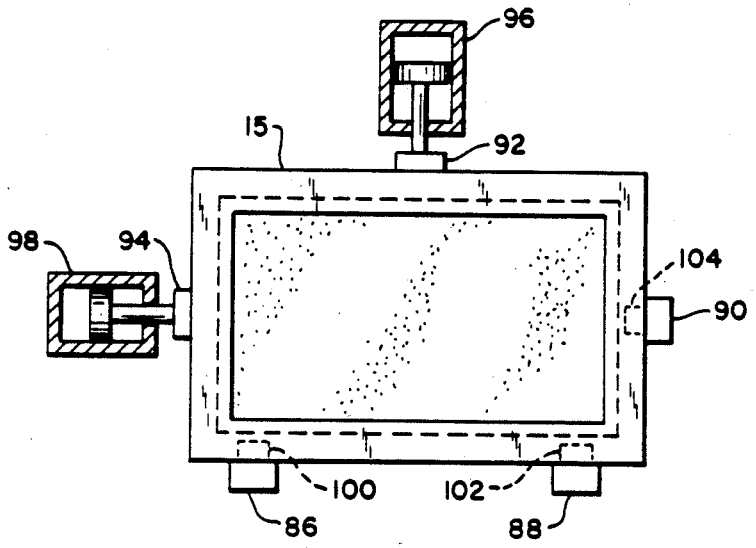
FIG. 9 is a plan view taken on lines 9—9 of FIG. 7, showing the register system of the invention.

Referring now to FIG. 9, the register system at the drag mold forming station 18 will be described. After the empty flask 15 has been set down on the pattern board 72, and the fingers 70 have disengaged, a pair of stop members 86, 88 lying along the longitudinal side of the flask, and a third stop member 90 lying along the transverse side of the flask, are employed. These stop members like those of FIG. 5, are typically mounted on the pattern or pattern support holster. A pair of pusher members 92 and 94 are employed to move the flask into position. The piston-cylinder actuator 96 for pusher 92 is then actuated, so as to push the flask over until it contacts stops 86, 88. Actuator 98 is then actuated, so that pusher member 94 moves the flask 15 into contact with stop 90. At this time, the flask 15 has been accurately indexed, or positioned, with respect to the pattern, and the sand can thereafter be poured in and the drag mold can be finished. Hardened steel wear plates 100, 102 and 104 may be attached onto the sides of the flask 15 to coact with the stops 86, 88 and 90, so that they do not quickly wear out at these points. The stops can also be made of hardened steel. As can be seen, the register system for the drag molds is exactly the same as that for the cope molds, with one major exception. Since the drag molds are rolled over in rollover station 20 (FIG. 1), the stops 86, 88 are in the lower portion of FIG. 9, whereas stops 50, 52 are in the upper portion of FIG. 5. When the drag molds enter the closer station 24 (FIG. 1), the indexing or registry points of both the cope and drag flasks will coincide at the parting face flanges.

Figure 10A:
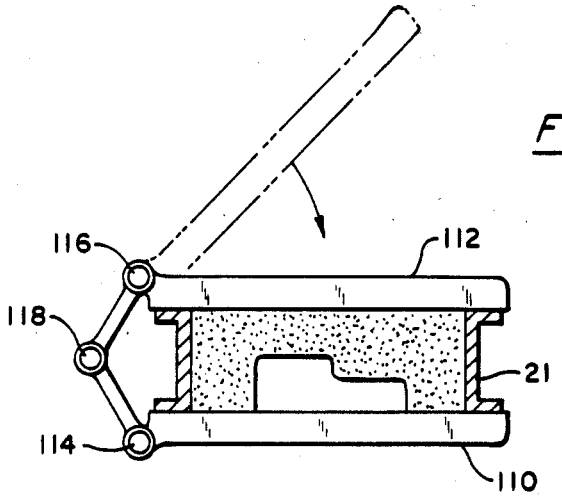
FIGS. 10*a*, 10*b*, and 10*c* show the rollover station, for the drag flasks.
Figure 10B:
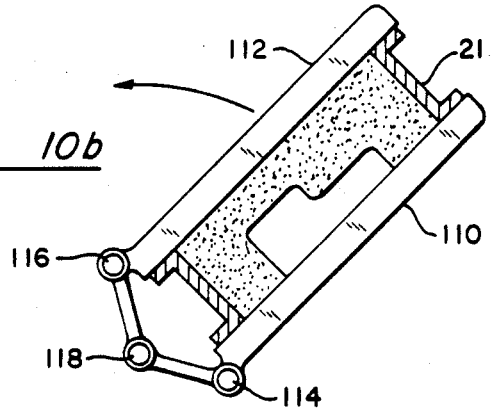
Figure 10C:
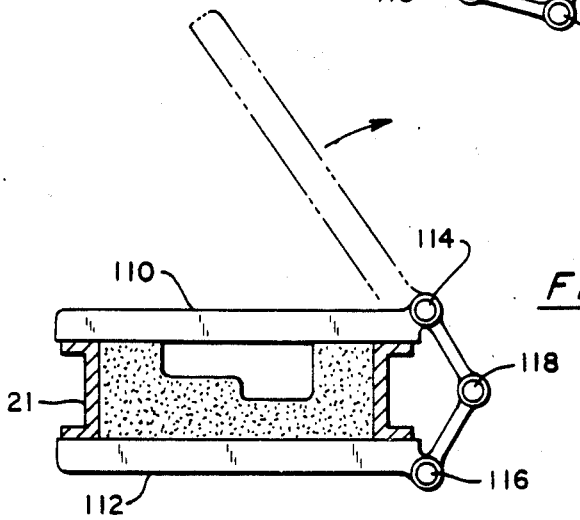

Referring now to FIGS. 10*a* 10*b* and 10*c* the rollover station 20 is shown in more detail. A pair of jaws 110, 112 are each separately pivotable about its own pivot point 114, 116 respectively. In addition, both arms or jaws can be rotated together about pivot 118. When a flask 21 moves into the rollover station 20, jaw 110 is in its horizontal position as seen in FIG. 10*a*, and jaw 112 is in its upward position, shown in dashed lines. After the flask has been placed on lower jaw 110, upper jaw 112 is rotated clockwise about pivot point 116, so that the flask is tightly gripped or secured between the two jaws. The entire assemblage is then rotated approximately 180° counter-clockwise about shaft 118 (FIG. 10*b*), as to place the flask in alignment with the end of conveyor 22 (FIG. 1) jaw 110 is then rotated upwardly about pivot 114 (FIG. 10*c*). A pusher member 120 (FIG. 1) is then actuated, which pushes the flask onto the conveyor 22. The jaws are then rotated back to their original position, so as to be ready for the next flask coming from the drag mold making station 18.

Figures 11, 11A:
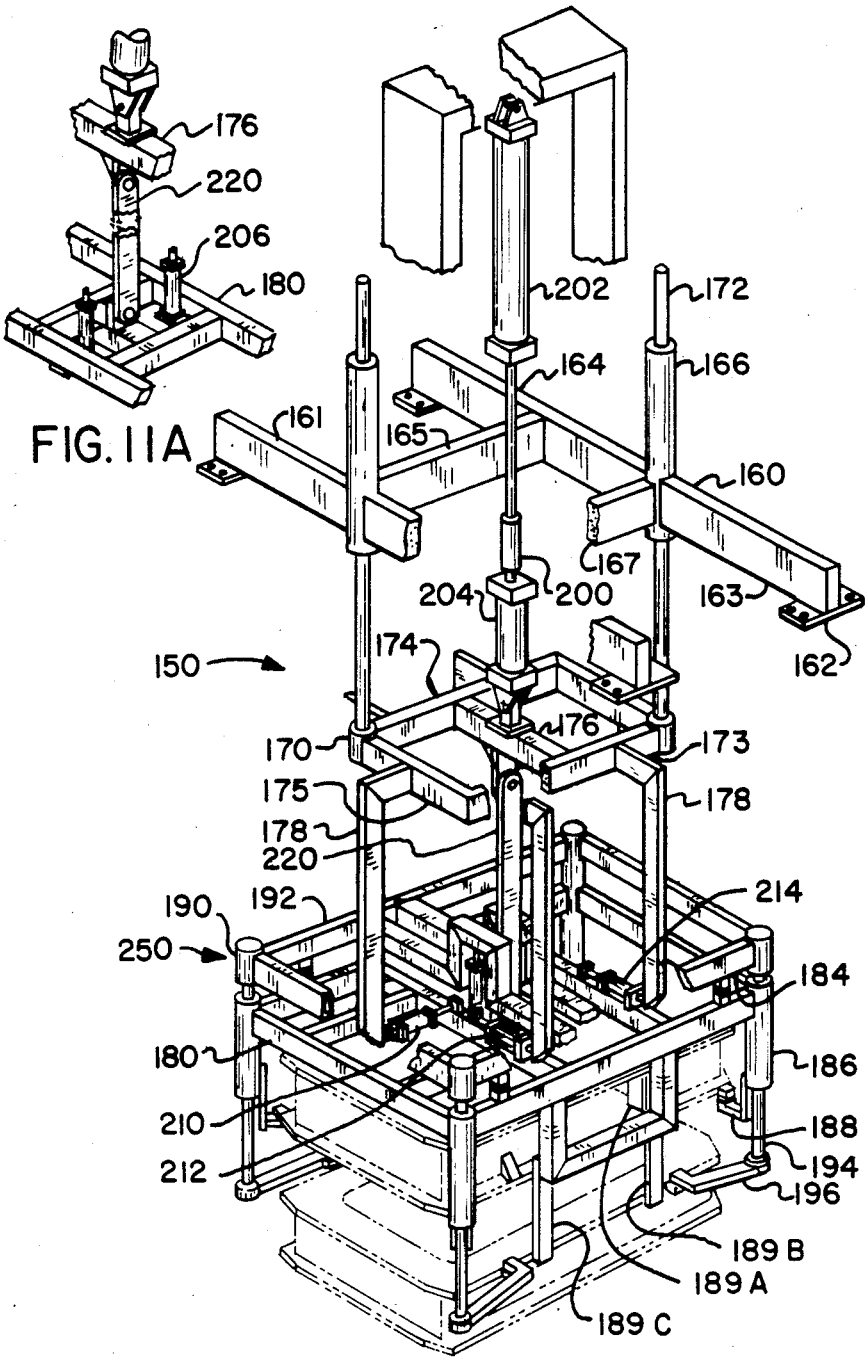
FIG. 11 is a perspective view showing the closer station, where the mold halves are assembled.
FIG. 11*a* is an enlarged perspective view showing the suspension of the flask handling sub-assembly of the closer station of FIG. 11.

Referring now to FIG. 11, there is illustrated the assembly of the cope and drag mold halves at the closing station 24 (FIG. 1) by means of the improved closer 150 of the present invention. The improved closer 150 of the present invention is comprised of an upper support framework 160, an intermediate support framework 170, and a flask handling subassembly 250, which comprises a cope capture framework 180 and a drag contact framework 190. These frameworks are linked together in an unique cooperative association which provides support and alignment of the cope and drag during closing of the mold while permitting controlled relative movement in order to assure parallelism between the cope and drag parting surfaces during the closing operation.

The upper support framework 160 provides a support frame from which the remaining frameworks are directly or indirectly suspended for support. The upper support framework 160 is, when used in conjunction with the synchronous registry system hereinbefore described, mounted through brackets 162 to a moveable support structure (not shown) which is with the continuously moving conveyor 22 such that there is no relative movement between the upper support framework 160 and the flasks on the conveyor during execution of the closure operation at the closing station 24. The upper support frame 160 comprises a substantially horizontally disposed ladder-like frame 164 and at least a pair of diagonally opposed tubular guide rod housings 166 mounted to and extending perpendicularly to the plane of the laterally spaced members 161 and 163 of the frame 164. Laterally spaced members 165 and 167 extend transversely between the spaced members 161 and 163 to provide structural rigidity to the frame 164 of the upper support framework 160.

The intermediate support framework 170 is suspended below the upper support framework 160 by means of guide rods 172 which extend upwardly from the rectangular planar main frame 174 of the intermediate support framework 170 through the tubular guide rod housings 166 mounted to the frame 164 of the upper support framework 160 such that the plane of the box-like main frame 174 of the intermediate support framework 170 is parallel to the plane of the ladder-like frame 164 of the upper support framework 160. Cross member 176 of the main frame 174, which extends transversely through the center of the planar main frame, is attached to piston-cylinder means 200, which preferably comprises a pair of piggybacked cylinders 202 and 204. The piston-cylinder means 200 serves to suspend the intermediate support framework 170 beneath the upper support framework 160 and also to control the movement of the intermediate support framework 170 relative to the upper support framework 160 guided by the translation of the guide rods 172 through the tubular guide rod housings 166 thereby permitting only pure vertical motion therebetween.

As best seen in FIG. 11, the intermediate support framework 170 is a spider-like structure comprising the substantially horizontal main frame 174 and a plurality of legs 178 disposed about the perimeter of the main frame 174 and mounted thereto so as to extend perpendicularly downward therefrom in a substantially vertical direction. Preferably, two legs 178 are disposed along each of the longitudinally extending members 173 of the main frame 174 and one leg is disposed along each of the transversely extending members 175 of the main frame 174.

The flask handling subassembly 250 is freely suspended from the intermediate support framework 170 such that the cope contact framework 180 and the drag contact framework 190 are suspended, directly and indirectly, respectively, from the intermediate support framework 170. The cope capture framework 180 is suspended directly from the cross member 176 by a suitable linkage means 220, such as a link bar or a cable, arranged for permitting tilting movement of the entire flask handling subassembly 250 relative to the intermediate support framework 170. The drag contact framework 190 is in turn suspended from the cope capture framework 180 through piston-cylinder means 206 so as to permit only axially directed relative movement therebetween to adjust the vertical position of the drag contact framework 190 with respect to the cope capture framework 180.

The cope capture framework 180 is comprised of a planar frame 184 having mounted to each of its corners a tubular member 186 which extends perpendicularly to the plane of the lower frame 184 to form a housing through which a guide rod 194 extends. This plurality of tubular members 186 serve collectively to guide the relative movement of the drag contact framework 190 with respect to the cope capture framework 180 so as to assure only pure vertical displacement therebetween.

The drag contact framework 190 comprises a planar main frame 192, having a size and shape generally commensurate with the size and shape of the lower planar frame 184 of the cope capture framework 180, and a plurality of guide rods 194 extending perpendicularly downward from the planar main frame 192, with one guide rod disposed at each corner thereof. Each guide rod 194 is aligned with and passes through a tubular guide rod housing 186 mounted to the lower planar frame 184 of the cope capture framework 180. To the lower end of each guide rod 194, there is mounted a drag locator arm 196. The drag locator arms are disposed in a plane perpendicular to the guide rods to which they are mounted so that they contact either the parting flange of the drag flask or an equivalently representative surface of the drag flask when lowered to the proper evaluation.

Similarly, a cope support arm 188 is mounted to each of the tubular guide rod housings 186 extending downwardly from the corners of the lower planar frame 184 of the cope capture framework 180. The cope support arms 188 extend inwardly in a plane perpendicular to the guide rod housings 186 so that the extension tabs on the flange of the cope flask will rest upon pads mounted to the extremity of each support arm when the cope flask is received into the cope capture framework 180.

In order to assure proper alignment of the cope flask and the drag flask with each other within the closer 150, a plurality of piston-cylinder actuators 210, 212, 214 are mounted the lower portion of the inner surface of the legs 178 extending downwardly from the planar main frame 174 of the spider-like intermediate support framework 170 and a plurality of registry bars 189A–189C are mounted to and extend downwardly from the lower planar frame 184 of the cope capture framework 180. Each registry bar 189A–189C cooperatively associated with a piston-cylinder actuator so that the registration bars may be urged upon actuation of the piston-cylinders against the cope flask and lot or the drag flask to definitely locate the cope flask and the drag flask relative to the identical used for molding and closing reference thereby assuring proper alignment therebetween.

The operation of the closer assembly 150 of the present invention will be described herein in use in conjunction with the registry system for mold making described hereinbefore with reference to FIGS. 1 through 10 and disclosed in commonly assigned U.S. Pat. No. 4,628,986. At the beginning of the closure operation, the entire closer assembly 150 is drawn up to its highest position above the conveyor 22 with the piston-cylinders 202, 204 and 206 each in a collapsed mode. With the closer assembly 150 in its highest position, the cope flask 23 is translated from conveyor 12 on powered rollers into position with the cope capture framework 180 beneath the lower planar frame 184 and slightly above the inwardly extending cope support arms 188. With the cope flask so positioned within the cope capture framework 180, the three piston-cylinder actuators 210, 212 and 214 are actuated to move the cope capture framework, which is freely suspended by suspension means 220 from the spider-like intermediate support framework 170, so that the registry bars 189A–189C extending downwardly from the lower planar frame 184 are brought into contact with the lower flange of the cope thereby assuring proper registry of the cope flask in both the longitudinal and transverse directions. Once the cope flask is in registry against the registry bars 189A–189C, the support rollers (not shown), by which the cope flask was positioned within the cope capture framework 180, are pivoted down and out to lower the cope flask 23, while still in registry, such that the cope flange extension tabs rest upon the pads on the fixed cope support arms 188 extending inwardly from the guide rod housings 186. Once so positioned, cylinders 21 are actuated to clamp and hold the cope flask 23 in position against the registry bars throughout the closure process. The captured cope is later "leveled" in a plane parallel to the plane of the drag contact frame 190.

Each of the piston-cylinder actuators 210, 212 and 214 is pivotally mounted at its cylinder base to the lower end of a downwardly extending leg 178 on the intermediate support framework 170 and fixedly mounted at its piston end to a cross member of the lower planar frame 184 of the cope capture framework 180, as best seen in FIG. 11. Piston-cylinder actuator 210 is disposed parallel to the longitudinal axis, i.e., the longer axis, of the cope flask received into the cope capture framework 180 and functions to move the cope capture framework 180 in the longitudinal direction to bring the registry bar 189A disposed along the transverse side of the captured cope flask into contact with the shorter transverse side of the cope flask 23. Piston-cylinder actuators 212 and 214 are disposed transverse to the longitudinal axis of the cope flask received into the cope capture framework 180 and function to move the cope capture framework 180 in the transverse direction to bring the registry bars 189B and 189C disposed along the longitudinal side of the captured cope flask into contact with the longer longitudinal side of the cope flask.

The registering and capturing of the cope flask in the closure operation is accomplished without bringing the closer assembly 150 into synchronous movement with the mold conveyor 22. However, before the drag flask is captured, synchronization of the closer assembly 150 with the moving conveyor 22 should be achieved. Upon achievement of synchronization, piston-cylinder 202 is actuated to extend its piston rod downwardly thereby lowering the intermediate support framework 170 and the cope capture framework 180, with the captured cope flask therein, and the drag contact framework 190 to the position illustrated in FIG. 11. During or before this lowering operation, the piston-cylinder actuators 210, 212 and 214 are actuated to reposition the cope capture framework 180 and the drag contact framework 190 to permit the registry bars 189A–189C to clear the drag flask 21 to be captured as the cope capture framework and drag contact framework are lowered.

Once the piston-cylinder 202 has lowered the cope capture and drag contact frameworks 250 to their intermediate position as shown in FIG. 11, the three piston-cylinder actuators 210, 212 and 214 are actuated to move the cope capture framework 180, and consequently the drag contact framework 190 associated therewith, so that the registry bars 189A–189C extending downwardly from the lower planar frame 184 are brought into contact with the upper flange of the drag flask 21 moving along the conveyor 22 in synchronization with and beneath the closer assembly 150.

It is important to note that when the cope capture framework 180 is moved to bring the registry bars 189A–189C into contact with the upper flange of the drag flask 21, that the captured cope flask is moved with the cope capture framework 180 and is therefore never disturbed from its position of registry with the registry bars 189A–189C. Thus, when the drag flask is brought in registry with the bars 189A–189C, it will be in proper position below the cope flask which is also in registry with the bars 189A–189C. The cope and drag are now properly aligned, as the cope and drag flask, which are both registered within the closer assembly 150 to the same registry bars 189A–189C prior to closure, have been preregistered as hereinbefore described to the pattern carrier to ensure that the center lines of the pattern halves are the same dimensions from the sets of register bars 50,52,54, and 86,88,90.

With the drag flask in registry against the registry bars 189A–189C, the piston-cylinder 204 is extended to lower the cope capture framework 180 and the drag capture framework 190 a little further to bring the pads mounted to the four drag locator arms 196 down against the tabs extending from the upper surface of the upper flange or other reference point on the drag flask thereby causing the lower planar frame 184 to be "leveled" parallel to the parting surface of the drag. As the cope flask is supported on the cope support arms 188 so as to be "leveled" parallel to the lower planar frame 184, the cope flask is also now "leveled" with the drag flask. Thus, the desired parallelism between the cope parting surface and the drag parting surface has been achieved. This parallelism is maintained during the remainder of the closure operation by the construction of the closer assembly 150 of the present invention whereby the drag capture framework 190 is mounted to the cope capture framework 180 by means of the guide rods 194 which pass through the tubular guide rod housings 186 so as to permit only guided movement along the guide rods with no longitudinal or lateral movement between the cope and drag. With the cope flask "leveled" to the drag flask in this manner, they will always be parallel no matter what the orientation of the drag mold since the subassembly of the cope capture framework 180 and drag contact framework 190 is freely suspended from the intermediate support framework 170.

Figure 13:
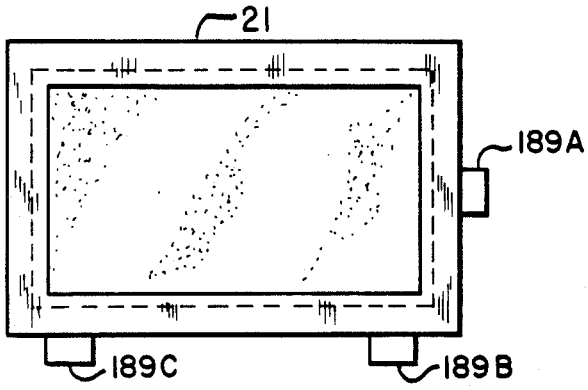
FIG. 13 is a view taken on lines 13—13 of FIG. 12.
Figure 12:
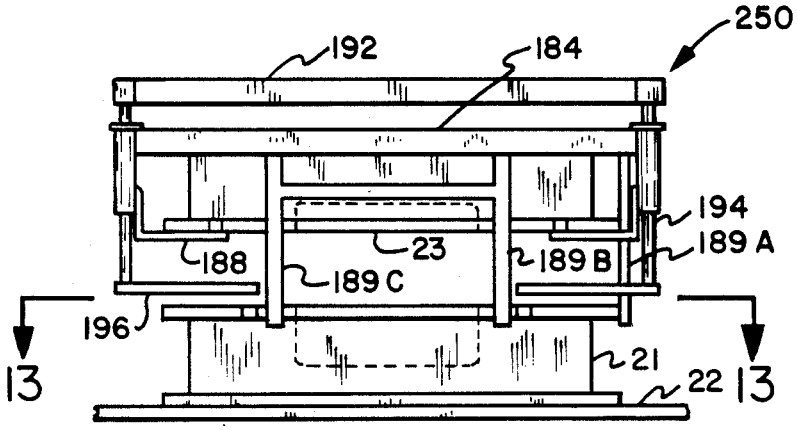
FIG. 12 is a plan view of the closer station showing the register system of the invention.

After achieving parallelism shortly after the start of the extension of the piston-cylinder 204, the cope and drag remain parallel and in contact with the registry bars as shown in FIGS. 12 and 13 as the extension of the piston-cylinder 204 continues moving the cope capture framework 180 downwardly guided by the sliding of the tubular guide rod housings 186 along the guide rods 194 to bring the cope flask down to rest atop the drag flask thereby completing closure. In this manner, the mold is closed with the assurance that neither misalignment nor detrimental mold to core contact will occur. The drag contact framework 190 does not move downward during this closure step as it is already resting against the upper surface of the upper flange of the drag flask which in turn is supported upon the conveyor 22 or an equivalent horizontal surface.

The piston-cylinder 204 is allowed to overtravel, i.e., continue extending after closure of the cope flask to the drag flask, in order to disengage the cope support arms from the lower surface of the lower flange of the cope flask. With the piston-cylinder 204 fully extended, the piston-cylinder 206 is actuated to push the drag contact framework 190 upwardly guided by the movement of the guide rods 194 through the tubular guide rod housings 186, thereby disengaging the drag contact framework 190 from the drag flask. Additionally, the piston-cylinder actuators 210, 212 and 214 are activated to urge the cope capture framework 180 in a longitudinal and lateral direction so as to move the registry bars 189A–189C out of contact with the closed cope and drag flasks. The moveable support carriage (not shown) from which the closer assembly 150 of the present invention is supported is then brought out of synchronization with the moving conveyor 22 and translated longitudinally backward a sufficient distance to bring the pads of the cope locator arms 188 from beneath the flange extension tabs on the lower flange of the cope flask, and piston-cylinders 202, 204 and 206 are collapsed to raise the combined sub-assembly of the intermediate support framework 170, the cope capture framework 180 and the drag contact framework 190 from the assembled mold, i.e., the closed cope and drag flasks. The collapsing of the piston-cylinders 202, 204 and 206 also returns the closer assembly 150 to its highest position from which another closure cycle will be initiated.

I claim:

1. In a mold making apparatus including in combination a first mold making means for making cope mold halves and a second mold making means for making drag mold halves, each of the first and second mold making means including a mold pattern, a longitudinal registration means for accurately positioning a mold half flask so that a longitudinal reference means on a longitudinally extending side of the flask is snug against a first register means, a transverse registration means for accurately positioning said mold half flask relative to the mold pattern by moving the flask so that a transverse reference means on an adjacent transversely extending side of the flask is snug against a second register means, for thereafter filling the registered flask with sand and compacting it to form a completed mold half; a closer station; means for moving the completed drag flask to the closer station with its cavity side positioned up; and means for moving the completed cope flask to the closer station with its cavity side positioned down so as to face the cavity in the drag flask; an improved closer assembly comprising:

a. an upper support framework having a substantially horizontally disposed planar frame and at least a pair of diagonally opposed guide rod housings mounted to and extending perpendicularly to the plane of the planar frame thereof;

b. an intermediate support framework having a substantially horizontal rectangular main frame and a plurality of bar-like members disposed about the perimeter of said rectangular main frame and extending perpendicularly downwardly therefrom to form a spider-like structure, said intermediate support framework having at least a pair of diagonally opposed guide rods mounted to and extending perpendicularly upward from said rectangular main frame, each of the guide rods passing through one of the guide rod housings of said upper support framework thereby permitting only pure vertical motion therebetween;

c. means operatively associated with said intermediate support framework for suspending said intermediate support framework beneath said upper support framework and for controlling the movement of the intermediate support framework relative to the upper support framework, which movement is guided by the translation of the intermediate support framework guide rods through the upper support framework guide rod housings;

d. a flask capture subassembly freely suspended from the rectangular main frame of said intermediate support framework so as to permit tilting of said flask capture subassembly relative to the rectangular main frame of said intermediate support framework, said flask capture subassembly adapted to receive a set of completed cope and drag flasks in spaced facing relationship and close said cope and drag flasks in registration thereby eliminating parting line shift; and e. first actuation means mounted between and operatively associated with said intermediate support framework and said flask capture subassembly for controllably moving said flask capture subassembly relative to said intermediate support framework in a longitudinal direction and in a transverse direction in a plane generally parallel to the plane of the planar main frame of said intermediate support framework.

2. In a mold making apparatus, an improved closer assembly as recited in claim 1 wherein said flask capture subassembly comprises:

a. a cope capture framework adapted to receive and support and clamp a completed cope flask and having a rectangular planar main frame sized to circumscribe the downwardly extending bar-like members of the intermediate support framework and a plurality of guide rod housings mounted at the corners of and extending perpendicularly to the plane of the rectangular main frame, the rectangular main frame of the cope capture framework being freely suspended from the rectangular main frame of the intermediate support framework;

b. a drag contact framework adapted to contact a completed drag flask and having a rectangular planar main frame disposed parallel to and in spaced relationship above the rectangular planar main frame of said cope capture framework and a plurality of guide rods mounted at the corners of and extending perpendicularly downward from the plane of the rectangular main frame of said drag contact framework, each of the guide rods passing through one of the guide rod housings of said cope capture framework;

c. second actuation means mounted between and operatively associated with the rectangular main frame of said cope capture framework and the rectangular main frame of said drag contact framework for controlling relative movement between the cope capture framework and the drag contact framework, which movement is guided by the translation of the drag contact framework guide rods through the cope capture framework guide rod housings; and d. a plurality of register bars mounted to and extending perpendicularly downward from the rectangular planar main frame of the cope capture framework, at least one register bar mounted to each of two adjacent sides of the rectangular planar main frame of the cope capture framework, said register bars disposed in cooperative relationship with said first actuation means whereby the register bars may be urged against the cope flask upon operation of the first actuation means and against the drag flask upon operation of the second actuation means so as to bring the cope and drag flasks into registration and mutual alignment.

3. In a mold making apparatus, an improved closer assembly as recited in claim 1 further comprising means for locating the upper flange of the drag flask to establish the plane of the upper surface of the drag flask and means for moving the cope capture framework perpendicular to said established plane during the closing operation whereby the cope flask is brought in contact with the drag flask at closing in a position parallel thereto.

4. A closer assembly adapted to receive a cope flask and a drag flask and to close same together to form a completed mold comprising:

a. an upper support framework having a substantially horizontally disposed planar frame and at least a pair of diagonally opposed guide rod housings mounted to and extending perpendicularly to the plane of the planar frame thereof;

b. an intermediate support framework having a substantially horizontal rectangular main frame and a plurality of bar-like members disposed about the perimeter of said rectangular main frame and extending perpendicularly downwardly therefrom to form a spider-like structure, said intermediate support framework having at least a pair of diagonally opposed guide rods mounted to and extending perpendicularly upward from said rectangular main frame, each of the guide rods passing through one of the guide rod housings of said upper support framework thereby permitting only pure vertical motion therebetween;

c. means operatively associated with said intermediate support framework for suspending said intermediate support framework beneath said upper support framework and for controlling the movement of the intermediate support framework relative to the upper support framework, which movement is guided by the translation of the intermediate support framework guide rods through the upper support framework guide rod housings;

d. a flask capture subassembly freely suspended from the rectangular main frame of said intermediate support framework so as to permit tilting of said flask capture subassembly relative to the rectangular main frame of said intermediate support framework, said flask capture subassembly adapted to receive a set of completed cope and drag flasks in spaced facing relationship and close said cope and drag flasks in registration thereby eliminating parting line shift; and e. first actuation means mounted between and operatively associated with said intermediate support framework and said flask capture subassembly for controllably moving said flask capture subassembly relative to said intermediate support framework in a longitudinal direction and in a transverse direction in a plane generally parallel to the plane of the planar main frame of said intermediate support framework.

5. A closer assembly as recited in claim 4 wherein said flask capture subassembly comprises:

a. a cope capture framework adapted to receive and support and clamp a completed cope flask and having a rectangular planar main frame sized to circumscribe the downwardly extending bar-like members of the intermediate support framework and a plurality of guide rod housings mounted at the corners of and extending perpendicularly to the plane of the rectangular main frame, the rectangular main frame of the cope capture framework being freely suspended from the rectangular main frame of the intermediate support framework;

b. a drag contact framework adapted to contact a completed drag flask and having a rectangular planar main frame disposed parallel to and in spaced relationship above the rectangular planar main frame of said cope capture framework and a plurality of guide rods mounted at the corners of and extending perpendicularly downward from the plane of the rectangular main frame of said drag contact framework, each of the guide rods passing through one of the guide rod housings of said cope capture framework;

c. second actuation means mounted between and operatively associated with the rectangular main frame of said cope capture framework and the rectangular main frame of said drag contact framework for controlling relative movement between the cope capture framework and the drag contact framework, which movement is guided by the translation of the drag contact framework guide rods through the cope capture framework guide rod housings; and d. a plurality of register bars mounted to and extending perpendicularly downward from the rectangular planar main frame of the cope capture framework, at least one register bar mounted to each of two adjacent sides of the rectangular planar main frame of the cope capture framework, said register bars disposed in cooperative relationship with said first actuation means whereby the register bars may be urged against the cope flask upon operation of the first actuation means and against the drag flask upon operation of the second actuation means to bring the cope and drag flasks into registration and mutual alignment.

6. A closer assembly as recited in claim 4 further comprising means for locating the upper flange of the drag flask to establish the plane of the upper surface of the drag flask and means for moving the cope capture framework perpendicular to said established plane during the closing operation whereby the cope flask is brought in contact with the drag flask at closing in a position parallel thereto.

* * * * *